US006228559B1

(12) United States Patent
Oda

(10) Patent No.: US 6,228,559 B1
(45) Date of Patent: May 8, 2001

(54) NEGATIVE WORKING WATERLESS LITHOGRAPHIC PRINTING PLATE PRECURSOR

(75) Inventor: Akio Oda, Shizuoka (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 0 days.

(21) Appl. No.: 09/207,683

(22) Filed: Dec. 9, 1998

(30) Foreign Application Priority Data

Dec. 12, 1997 (JP) ..... 9-342497

(51) Int. Cl.[7] ..... G03C 1/76
(52) U.S. Cl. ..... 430/272.1
(58) Field of Search ..... 430/272.1, 278.1, 430/302

(56) References Cited

U.S. PATENT DOCUMENTS 3,894,873 * 7/1975 Kobayashi et al. ..... 96/33
3,953,212 * 4/1976 Miyano et al. ..... 96/75
5,069,999 * 12/1991 Higashi et al. ..... 430/272
5,232,813 * 8/1993 Okuno et al. ..... 430/156
5,721,087 * 2/1998 Yokoya et al. ..... 430/200
5,786,125 * 7/1998 Tsuchiya et al. ..... 430/272.1
5,919,600 * 7/1999 Huang et al. ..... 430/272.1
5,958,652 * 9/1999 Suezawa ..... 430/303

FOREIGN PATENT DOCUMENTS 9-146265 6/1997 (JP) .

* cited by examiner

*Primary Examiner*—Hoa Van Le
*Assistant Examiner*—Barbara Gilmore
(74) *Attorney, Agent, or Firm*—Burns, Doane, Swecker & Mathis, LLP

(57) ABSTRACT

A negative working waterless lithographic printing plate precursor excellent in image reproducibility and scratch resistance and writable by laser beams, which comprises a support having thereon a light-sensitive layer and a silicone rubber layer provided on the light-sensitive layer, the light-sensitive layer being reduced in adhesion to the silicone rubber layer by exposure, wherein the light-sensitive layer comprises a polymer having at least one group selected from the group consisting of a siloxane group and an alkyl fluoride group and at least one group selected from the group consisting of an unsaturated double bond group and a hydroxyl group.

1 Claim, No Drawings

NEGATIVE WORKING WATERLESS LITHOGRAPHIC PRINTING PLATE PRECURSOR

FIELD OF THE INVENTION

The present invention relates to a lithographic printing plate precursor for preparing a negative working lithographic printing plate requiring no fountain solution (hereinafter also referred to as a waterless printing plate), and particularly to a negative working waterless lithographic printing plate having good image reproducibility and scratch resistance.

BACKGROUND OF THE INVENTION

As negative working light-sensitive lithographic printing plates requiring no fountain solution in which light-sensitive layers and silicone rubber layers are successively formed on supports, various kinds of plates have been proposed.

For example, the use of compositions in light-sensitive layers have been reported in JP-A-63-88556 (the term "JP-A" as used herein means an "unexamined published Japanese patent application") and JP-A-8-328240, the compositions comprising compounds generating acids by light (light acid generating agents), compounds hydrolyzed by acids to change in solubility and binder resins if necessary. JP-A-8-328240 describes a process comprising adding a compound having two or more enol ether groups or enol thioether groups and a linear polymer having an acid group and a hydroxyl or mercapto group to the above-mentioned light-sensitive layer, thereby forming a three-dimensionally crosslinked resin in coating and drying or by heating after coating and drying, hydrolyzing the crosslinked portion in the presence of an acid generated from a light acid generating agent, for an exposed area, to improve the peeling property of a silicone rubber layer at the exposed area, and effectively removing a solubilized portion of the light-sensitive layer by use of a developing solution.

On the other hand, with the recent rapid progress in prepress systems and output systems such as image setters and laser printers, methods for obtaining printing plates by converting printing images to digital data, and using new prepress processing systems such as computer-to-plate and computer-to-cylinder systems have been proposed. Accordingly, new types of printing materials for these printing systems have been desired, and the development thereof is proceeding.

JP-B-42-21879 (the term "JP-B" as used herein means an "examined Japanese patent publication"), JP-A-50-158405, JP-A-6-55723, JP-A-6-186750, U.S. Pat. No. 5,353,705 and PCT International Publication WO-9401280 describe that ink-repellent silicone rubber layers are formed on light-heat conversion layers containing laser light absorbers such as carbon black and self-oxidizing binders such as nitrocellulose, and that the silicone rubber layers are partially removed by laser beam irradiation to form ink-receiving areas, thereby conducting waterless printing.

In the above, however, the silicone rubber layers are removed by abrasion of the light-heat conversion layers due to laser beam irradiation, and since the adhesion between the light-heat conversion layers and the silicone rubber layers is weak, JP-A-9-146265 reports a process of improving the above-mentioned adhesion by adding an addition polymer having groups reactive to a silicone crosslinking agent on side chains to a light-heat conversion layer, and allowing the polymer to react with the silicone crosslinking agent contained in a silicone rubber layer in coating and drying of the silicone rubber layer.

However, the above-mentioned known negative working light-sensitive lithographic printing plate requiring no fountain solution is insufficient yet in the adhesion between the light-sensitive layer and the silicone rubber layer, and has the problem that the plate is easily scratched in handling the printing plate and in printing, resulting in adhesion of ink on the scratched portion to form an image area. In particular, in the negative working waterless lithographic printing plate, the silicone rubber remains on an unexposed area, so that it is required that the light-sensitive layer is sufficiently adhered with the silicone rubber layer. Insufficient adhesion results in removal of the silicone rubber in a portion where the light-sensitive layer must be adhered with the silicone rubber layer in development, particularly the silicone rubber layer of a nonimage area around the periphery of an image area where the silicone rubber has been removed, which causes a reduction in resolution of an image.

Moreover, the above-mentioned process has the problem that if the crosslinking component in the light-sensitive layer is used in an increased amount for improving the reactivity with the crosslinking agent in the silicone rubber layer to improve the adhesive properties, or if the silicone rubber layer is dried at high temperature for a long period of time in coating for allowing the crosslinking reaction to occur easily, the performance of the light-sensitive layer is deteriorated to cause failure to obtain a good image.

SUMMARY OF THE INVENTION

An object of the present invention is to solve the above-mentioned problems and provide a negative working waterless lithographic printing plate precursor having good image reproducibility and scratch resistance, in which laser writing is possible.

As a result of intensive investigation, the present inventors have discovered that the above-mentioned problems can be solved by (1) a negative working waterless lithographic printing plate precursor comprising a support having thereon a light-sensitive layer and a silicone rubber layer provided on the light-sensitive layer, the light-sensitive layer being reduced in adhesion to the silicone rubber layer by exposure, wherein the light-sensitive layer comprises a polymer having at least one group selected from the group consisting of a siloxane group and an alkyl fluoride group (hereinafter referred to as a siloxane group and/or an alkyl fluoride group) and at least one group selected from the group consisting of an unsaturated double bond group and a hydroxyl group (hereinafter referred to as an unsaturated double bond group and/or a hydroxyl group); and as a preferred embodiment, (2) the negative working waterless lithographic printing plate precursor described in the above (1), wherein the light-sensitive layer further contains a compound converting a laser beam to heat.

In the present invention, the polymer having a siloxane group and/or an alkyl fluoride group, in addition to an unsaturated double bond group and/or a hydroxyl group having adhesion to the silicone rubber layer, is contained in the light-sensitive layer, whereby the concentrated polymer exists in a surface portion of the light-sensitive layer in coating and drying of the silicone rubber layer. Accordingly, the above-mentioned unsaturated double bond group and/or hydroxyl group effectively reacts with the silicone crosslinking agent of the silicone rubber layer to form a covalent bond, so that even addition of the polymer in a smaller amount results in a very strong bond between the silicone rubber layer and the light-sensitive layer, thereby conceivably showing the great effect of improving the image reproducibility and scratch resistance.

DETAILED DESCRIPTION OF THE INVENTION

The present invention will be illustrated in detail below.

The crosslinked silicone rubber layer used in the present invention is a coating formed by hardening the following composition A (condensation type silicone) or composition B (addition type silicone):

Composition A:

| | | |
|---|---|---|
| (a) | Diorganopolysiloxane (number average molecular weight: 3,000 to 40,000) | 100 parts by weight |
| (b) | Condensation Type Crosslinking Agent | 3 to 70 parts by weight |
| (c) | Catalyst | 0.01 to 40 parts by weight |

The diorganopolysiloxane of the above-mentioned component (a) is a polymer having repeating units represented by formula (1):

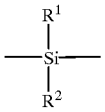

(1)

wherein $R^1$ and $R^2$ each represents an alkyl group (e.g., methyl, ethyl, propyl, isopropyl, butyl and nonyl) having 1 to 10 carbon atoms, an alkenyl group (preferably, a vinyl group) having 2 to 10 carbon atoms or an aryl group (e.g., phenyl, naphthyl, o-methylphenyl and p-methylphenyl) having 6 to 20 carbon atoms, which may have another appropriate substituent group. In general, it is preferred that 60% or more of $R^1$ and $R^2$ are methyl groups, vinyl halide groups and phenyl halide groups.

Such a diorganopolysiloxane preferably has hydroxyl groups at both ends thereof.

The above-mentioned component (a) has a number average molecular weight of 3,000 to 40,000, and preferably 5,000 to 36,000.

The component (b) may be any as long as it is of the condensation type, but an agent represented by the following formula is preferred:

$R^1m{\cdot}Si{\cdot}Xn(m+n=4,\ n \text{ is 2 or more})$ wherein $R^1$ has the same meaning as $R^1$ given above, and X is the following substituent group:

(1) A halogen atom such as Cl, Br or I, or (2) H, OH or an organic substituent group such as $—OCOR^3$, $—OR^3$, $—O—N{=}C(R^4)R^5$ or $—N(R^4)R^5$, wherein $R^3$ is an alkyl group (e.g., methyl, ethyl, propyl, isopropyl, butyl and nonyl) having 1 to 10 carbon atoms or an aryl group (e.g., phenyl, naphthyl, o-methylphenyl and p-methylphenyl) having 6 to 20 carbon atoms, and $R^4$ and $R^5$ are each an alkyl group (e.g., methyl, ethyl, propyl, isopropyl, butyl and nonyl) having 1 to 10 carbon atoms.

The component (c) is a well-known catalyst such as a carboxylate of a metal such as tin, zinc, lead, calcium or manganese, for example, tin dibutyl laurate, lead octylate or lead naphthenate, or chloroplatinic acid.

Composition B:

| | | |
|---|---|---|
| (d) | Addition Reactive Functional Group-Containing Diorganopolysiloxane (number average molecular weight: 3,000 to 40,000) | 100 parts by weight |
| (e) | Organohydrogenpolysiloxane | 0.1 to 10 parts by weight |
| (f) | Addition Catalyst | 0.00001 to 1 part by weight |

The addition reactive functional group-containing diorganopolysiloxane of the above-mentioned component (d) is an organopolysiloxane (having a number average molecular weight of 3,000 to 40,000) having at least two alkenyl groups (preferably, vinyl groups) each having 2 to 10 carbon atoms in one molecule, the alkenyl groups being directly bonded to silicon atoms. The alkenyl groups may be positioned either at ends of the molecule or at intermediate portions thereof. The component (d) may have unsubstituted or substituted alkyl groups (e.g., methyl, ethyl, propyl, isopropyl, butyl, nonyl and chloromethyl) each having 1 to 10 carbon atom or aryl groups (e.g., phenyl, naphthyl, o-methylphenyl, p-methylphenyl, o-chlorophenyl and p-chlorophenyl) each having 6 to 20 carbon atom, as organic groups other than the alkenyl groups. Further, the component (d) may also contain hydroxyl groups in slight amounts.

The number average molecular weight of the component (d) is 3,000 to 40,000, and more preferably 5,000 to 36,000.

The component (e) includes, for example, polydimethylsiloxanes each having hydrogen atoms at both ends, α,ω-dimethylpolysiloxanes, methylsiloxane-dimethylsiloxane copolymers each having methyl groups at both ends, cyclic polymethylsiloxanes, polymethylsiloxanes each having trimethylsilyl groups at both ends, and dimethylsiloxane-methylsiloxane copolymers each having trimethylsilyl groups at both ends.

Although the component (f) is arbitrarily selected from well-known catalysts, a platinum compound is particularly preferred. Examples of the platinum compounds include platinum, platinum chloride, chloroplatinic acid and olefin-coordinated platinum. In order to regulate the hardening rate of the composition, it is also possible to add a crosslinking inhibiting agent, for example, a vinyl group-containing organopolysiloxane such as tetracyclo(methyl-vinyl) siloxane, a carbon-carbon triple bond-containing alcohol, acetone, methyl ethyl ketone, methanol, ethanol or propylene glycol monomethyl ether.

The silicone rubber layer may contain an inorganic fine powder such as silica, calcium carbonate or titanium oxide, and/or an adhesive auxiliary such as a silane coupling agent, a titanate coupling agent or an aluminum coupling agent, if necessary.

If the thickness of the silicone rubber layer used in the present invention is too thin, the ink repellency is decreased to cause easy generation of scratches. On the other hand, too thick the thickness results in deterioration of developing properties. The thickness is therefore preferably 0.5 $g/m^2$ to 5 $g/m^2$, and more preferably 1 $g/m^2$ to 3 $g/m^2$.

In the light-sensitive lithographic printing plates requiring no fountain solution illustrated herein, the silicone rubber layers may be further coated with various silicone rubber layers.

Further, for surface protection of the silicone rubber layers, the silicone rubber layers may be laminated with transparent films, for example, formed of polyethylene, polypropylene, polyvinyl chloride, polyvinylidene chloride, polyvinyl alcohol, polyethylene terephthalate or cellophane, or may be coated with these polymers. Oriented films may be used as such films. Furthermore, the matting treatment may be applied to these films. However, the films to which no matting treatment is applied are preferred in the present invention.

Then, the light-sensitive layer reduced in adhesion to the silicone rubber layer by exposure will be described in detail.

In the present invention, the above-mentioned light-sensitive layer contains a polymer having a siloxane group and/or an alkyl fluoride group (a functional group localized in a surface portion) and an unsaturated double bond group and/or a hydroxyl group (a group reactive to the silicone crosslinking agent of the silicone rubber layer).

Examples of the above-mentioned polymers used in the present invention include addition copolymers containing repeating units having unsaturated double bond groups and/or hydroxyl groups on side chains and repeating units having siloxane groups and/or alkyl fluoride groups, and addition copolymers containing repeating units having unsaturated double bond groups and/or hydroxyl groups and siloxane groups and/or alkyl fluoride groups.

One characteristic of the polymers used in the present invention is that inclusion of the siloxane groups and/or alkyl fluoride groups allows the polymers to shift to and concentrate in the surface portions of the light-sensitive layers.

Examples of chemical structures of the siloxane groups include —O—Si($R^{11}$)($R^{12}$)($R^{13}$) (wherein $R^{11}$, $R^{12}$ and $R^{13}$, which may be the same or different, each represents a hydrocarbon group which may be substituted) and polysiloxane structures.

Chemical structures of the alkyl fluoride groups include, for example, $C_hF_{2h+1}$ (wherein h is an integer of 1 to 12), —$(CF_2)_jCF_2H$ (wherein j is an integer of 1 to 11) and —C($R^{14}$)($R^{15}$)—C($R^{16}$)($R^{17}$)—(wherein at least one of $R^{14}$, $R^{15}$, $R^{16}$ and $R^{17}$ represents a fluorine atom, and the others each represents a hydrogen atom).

The addition polymer used in the present invention may contain at least two kinds of the repeating units having unsaturated double bond groups and/or hydroxyl groups on side chains, the repeating units having siloxane groups and/or alkyl fluoride groups, and the repeating units having unsaturated double bond groups and/or hydroxyl groups and siloxane groups and/or alkyl fluoride groups.

Further, the addition polymer may contain repeating units having neither unsaturated double bond groups and/or hydroxyl groups, nor siloxane groups and/or alkyl fluoride groups. There is no particular limitation on compounds used in such copolymerization, as long as they are addition-polymerizable monomers having ethylenically unsaturated bonds.

Preferred examples of the repeating units having unsaturated double bond groups and/or hydroxyl groups on side chains include repeating units represented by formula (A), and preferred examples of the repeating units having siloxane groups and/or alkyl fluoride groups on side chains include repeating units represented by formula (B).

(A)

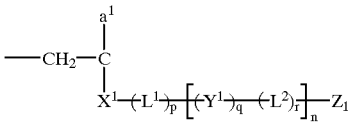

-continued (B)

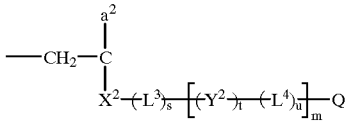

In general formulas (A) and (B), $a^1$ and $a^2$ each represents a hydrogen atom or a methyl group, $X^1$ and $X^2$ each represents —COO—, —CONH— or a phenylene group, $Y^1$ and $Y^2$ each represents —COO—, —OCO—, —CONH—, —NHCO—, —NHCOO—, —OCONH—, —O—, —S—, —NH— or a phenylene group, $L^1$, $L^2$, $L^3$, $L^4$ and $L^5$ each represents a substituted or unsubstituted alkylene group having 1 to 20 carbon atoms, $Z^1$ represents —C═$CH_2$, —C($CH_3$)═$CH_2$ or a hydroxyl group, p, q, r, s, t and u each represents 0 or 1, n and m each represents an integer of 0 to 30, and Q represents a group represented by the following formulas:

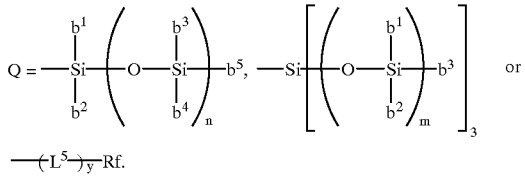

wherein $b^1$, $b^2$, $b^3$, $b^4$ and $b^5$ each represents a substituted or unsubstituted alkylene group having 1 to 4 carbon atoms or a phenylene group, and Rf represents a fluoroalkyl group having 1 to 10 carbon atoms.

Further, unsaturated double bond groups and/or hydroxyl groups and siloxane groups and/or alkyl fluoride groups may be contained in the same repeating units, and preferred examples of such repeating units include repeating units represented by formula (C), (D) or (E):

(C)

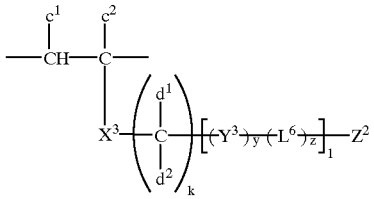

(D)

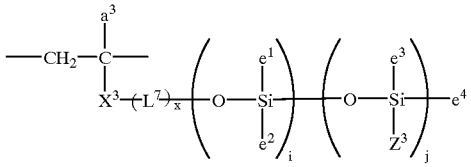

(E)

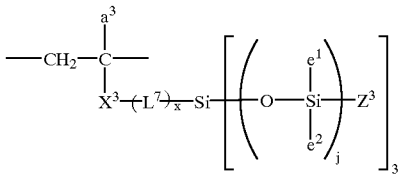

In general formula (C) to (E), $c^1$ and $c^2$ each represents a hydrogen atom or —$CF_3$, $d^1$ and $d^2$ each represents a hydrogen atom or a fluorine atom, $X^3$ represents —COO—, —CONH— or a phenylene group, $L^6$ and $L^7$ each represents a substituted or unsubstituted alkylene group having 1 to 20 carbon atoms, $Y^3$ represents —COO—, —OCO—, —CONH—, —NHCO—, —NHCOO—, —OCONH—, —O—, —S—, —NH— or a phenylene group, x, y and z each represents 0 or 1, k represents an integer of 1 to 5, 1 represents an integer of 0 to 3, $Z^2$ represents —C═$CH_2$, —C($CH_3$)═$CH_2$ or a hydroxyl group, $Z^3$ represents a group represented by the following formula, $a^3$ represents a hydrogen atom or a methyl group, $e^1$, $e^2$, $e^3$ and $e^4$ each represents a methyl group or a phenyl group, and i and j each represents an integer of 0 to 30.

$Z^3$ =

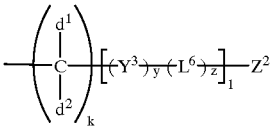

Preferred examples of the repeating units having unsaturated double bond groups and/or hydroxyl groups on side chains, the repeating units having siloxane groups and/or alkyl fluoride groups on side chains, and the repeating units having unsaturated double bond groups and/or hydroxyl groups and siloxane groups and/or alkyl fluoride groups in the same repeating units, which are used in the present invention, are shown below. However, the scope of the present invention is not limited thereto.

Examples of Compounds Represented by Formula (A)

(A-1)

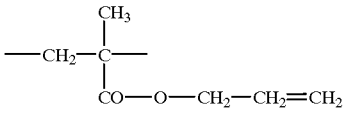

-continued (A-2)

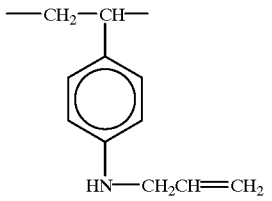

(A-3)

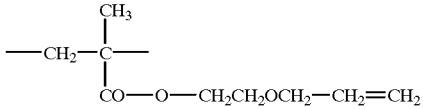

(A-4)

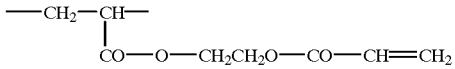

(A-5)

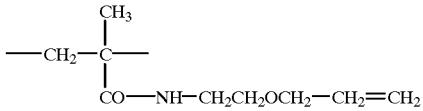

(A-6)

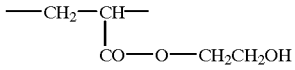

(A-7)

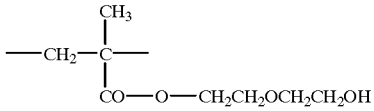

(A-8)

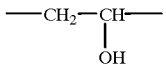

Examples of Compounds Represented by Formula (B)

(B-1)

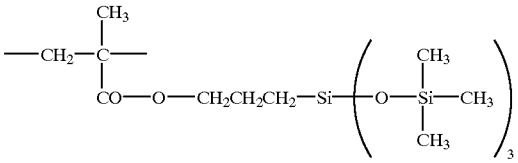

(B-2)

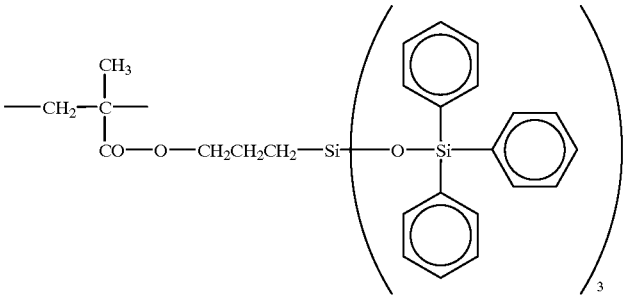

-continued
(B-3)
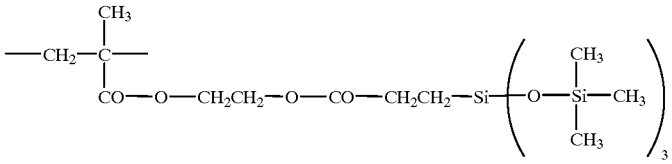
(B-4)
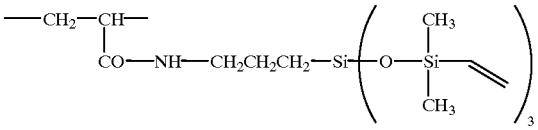
(B-5)
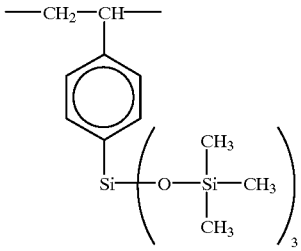
(B-6)
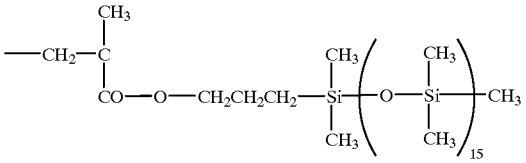
(B-7)
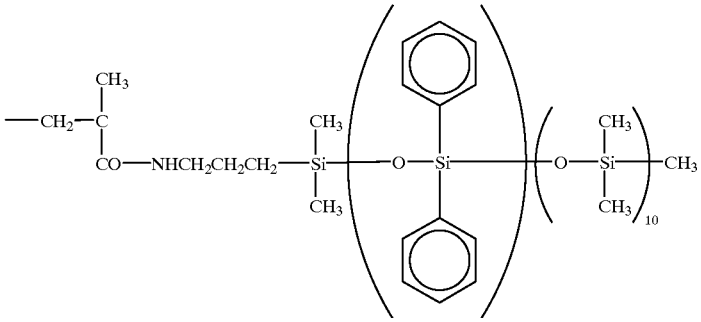
(B-8)
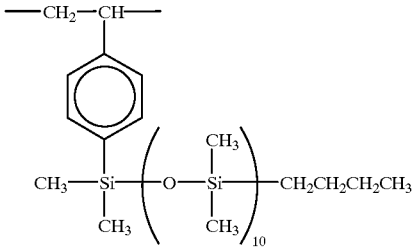
(B-9)
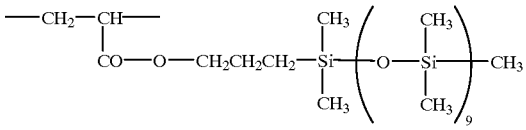
Examples of Compounds Represented by Formula (C)
(C-1)
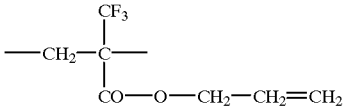
(C-2)
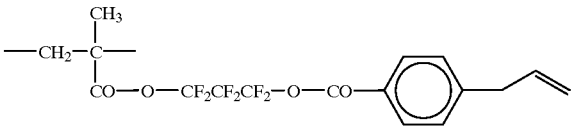
-continued
(C-3)
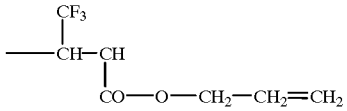
(C-4)
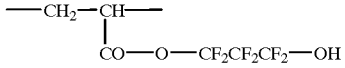

-continued
(C-5)
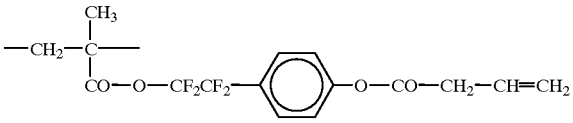
(C-6)
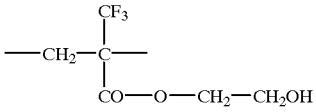
Examples of Compounds Represented by Formula (D)
(D-1)
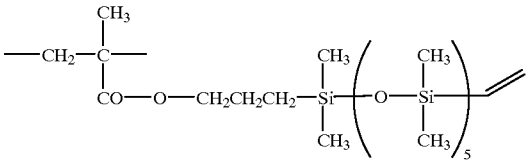
(D-2)
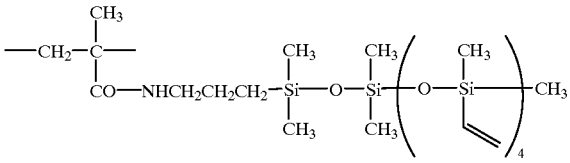
(D-3)
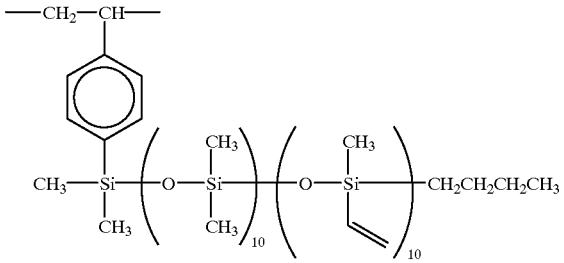
(D-4)
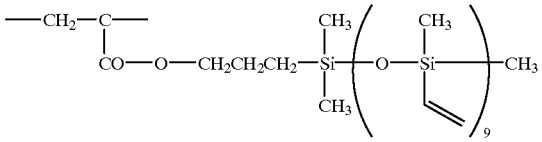
(D-5)
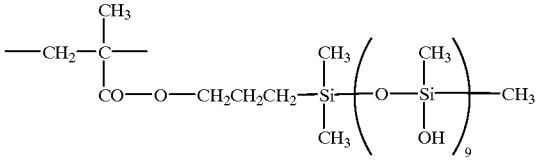
-continued
(D-6)
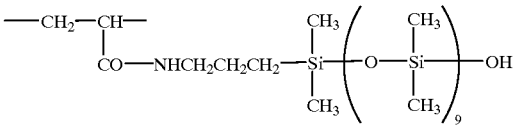
Examples of Compounds Represented by Formula (E)
E-1
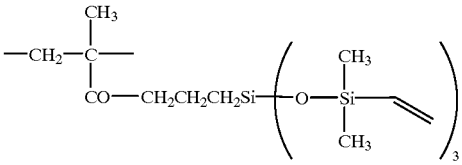
E-2
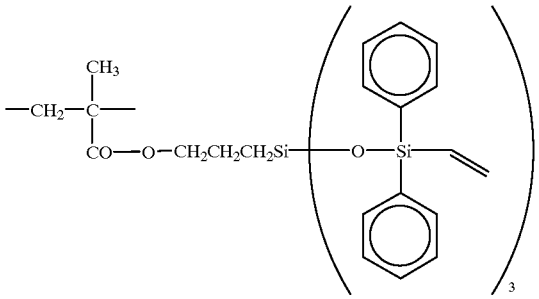
E-3
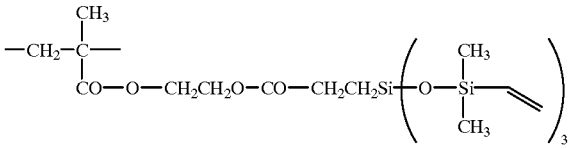
E-4
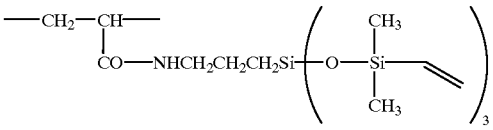
E-5
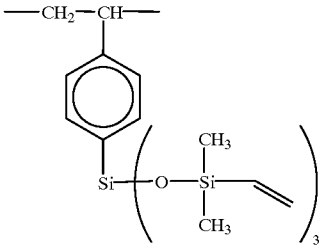
E-6
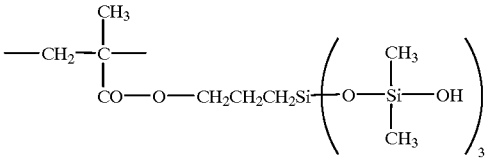

-continued

E-7

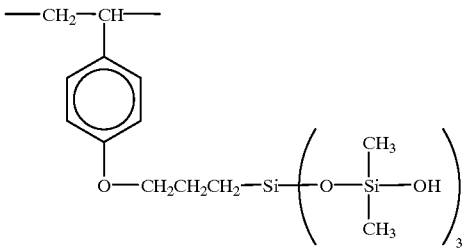

The above-mentioned addition polymers used in the present invention can be obtained by addition polymerization of addition-polymerizable ethylenically unsaturated monomers having unsaturated double bond groups and/or hydroxyl groups with addition-polymerizable ethylenically unsaturated monomers having siloxane groups and/or alkyl fluoride groups, or addition polymerization of addition-polymerizable ethylenically unsaturated monomers having unsaturated double bond groups and/or hydroxyl groups and siloxane groups and/or alkyl fluoride groups in the same compounds. Further, they can also be obtained by introduction of unsaturated double bond groups and/or hydroxyl groups and siloxane groups and/or alkyl fluoride groups into addition polymers by polymer reaction.

With respect to the content of each component, when the repeating units (A) having unsaturated double bond groups and/or hydroxyl groups on side chains and the repeating units (B) having siloxane groups and/or alkyl fluoride groups on side chains are separately used, the (weight) ratio of the repeating units (A) to (B) is from 1:10 to 10:1, and preferably from 1:5 to 5:1. The total content of both components is preferably from 3 to 50% by weight, and more preferably from 5 to 30% by weight, based on the above-mentioned addition polymer used for improving the adhesive properties.

When unsaturated double bond groups and/or hydroxyl groups and siloxane groups and/or alkyl fluoride groups are contained in the same repeating units, the content of the repeating units is preferably from 3 to 50% by weight, and more preferably from 5 to 30% by weight, based on the above-mentioned addition polymer used for improving the adhesive properties.

The above-mentioned addition polymers used in the present invention are contained in the light-sensitive layers reduced in adhesion to the silicone rubber layers by exposure. The adhesion is reduced when the bond between the light-sensitive layer and the silicone layer is broken, when the polymer constituting the light-sensitive layer is decomposed to reduce a cohesive force in the interface of the light-sensitive layer and the silicone layer, when cohesive failure explosively occurs in the light-sensitive layer, when the light-sensitive layer partly disappears, and when the light-sensitive layer is melted.

Such light-sensitive layers may be light-heat conversion layers containing compounds converting light to heat, and changes as described above may be developed by application of heat.

The light-heat conversion layers containing the compounds converting laser beams to heat, which are used as the light-sensitive layers, will be described below.

The light-heat conversion layers used in the present invention are layers having the function of converting laser beams used for writing to heat (light-heat conversion), and contain at least light-heat conversion agents together with the above-mentioned addition polymers used in the present invention.

The light-heat conversion agents include as inorganic pigments various carbon blacks such as acidic carbon black, basic carbon black, neutral carbon black and various carbon blacks surface-modified or surface-coated for improving dispersibility; organic pigments such as Nigrosine pigments, organic dyes such as various compounds described in Matsuoka, *Infrared Sensitizing Dyes*, Plenum Press, New York, N.Y. (1990), U.S. Pat. No. 4,833,124, EP-321,923, U.S. Pat. Nos. 4,772,583, 4,942,141, 4,948,776, 4,948,777, 4,948,778, 4,950,639, 4,912,083, 4,952,552 and 5,023,229, and metals and metal oxides such as aluminum, indium-tin oxides, tungsten oxide, manganese oxide and titanium oxide. In addition, conductive polymers such as polypyrroles and polyanilines can also be used.

The amount thereof used is from 5 to 50% by weight, preferably from 8 to 45% by weight, and more preferably from 10 to 40% by weight, based on the total solid weight of the light-heat conversion layer.

In addition to the addition polymers used in the present invention, polymers having film-forming ability may be used in the light-heat conversion layers used in the present invention. Examples of the polymers used in the light-heat conversion layers include cellulose, cellulose derivatives such as nitrocellulose and ethyl cellulose, homopolymers and copolymers of acrylates and methacrylates such as polymethyl methacrylate and polybutyl methacrylate, homopolymers and copolymers of styrenic monomers such as polystyrene and poly(a-methylstyrene), various synthetic rubbers such as isoprene rubber and styrene-butadiene rubber, homopolymers of vinyl esters such as polyvinyl acetate, copolymers thereof such as vinyl acetate-vinyl chloride copolymers, various condensation polymers such as polyureas, polyurethanes, polyesters and polycarbonates, and binders used in so-called "chemical amplification systems" described in Frechet et al., *J. Imaging Sci.*, 30(2), 59–64 (1986), Ito and Willson, *Polymers in Electronics* (*Symposium Series*), 242, 11, T. Davidson, Ed., ACS Washington, DC (1984) and E. Reichmanis and L. F. Thompson, *Microelectronic Engineering,* 13, 3–10 (1991).

The amount thereof used is from 0 to 50% by weight, preferably from 10 to 40% by weight, and more preferably from 15 to 35% by weight, based on the total solid component weight of the light-heat conversion layer.

Other additives are added depending on various purposes of improving the laser recording sensitivity of the light-heat conversion, improving the dispersibility of dispersions contained, in the light-heat conversion layers, and improving the adhesion to the adjacent layers such as supports and primer layers.

For example, in order to improve the laser recording sensitivity, it is conceivable to add well-known compounds which are decomposed by heating to generate gases. In this case, the laser recording sensitivity can be improved by ad sudden volume expansion of the light-heat conversion layers. Examples of these additives include azidodicarbonamide, sulfonylhydrazine and dinitrosopentamethylenetetramine.

Further, well-known compounds which are decomposed by heating to produce acidic compounds can be used as additives. The use of these compounds in combination with binders in the chemical amplification systems can greatly lower the decomposition temperature of constituent substances of the light-heat conversion layers, resulting in an improvement in the laser recording sensitivity. Examples of these compounds include various kinds of iodonium salts, sulfonium salts, phosphonium tosylates, oxime sulfonates, dicarbodiimide sulfonates and triazine derivatives.

When pigments such as carbon black are used as the light-heat conversion agents, the degree of dispersion of the pigments sometimes affects the laser recording sensitivity. Various agents for dispersing the pigments are therefore used as additives.

In order to improve the adhesive properties, well-known adhesion improvers (for example, silane coupling agents and titanate coupling agents) may be added.

Besides, various additives such as surfactants for improving the coating properties may be used if necessary.

The above-mentioned light-heat conversion layer compositions used in the present invention are dissolved in appropriate solvents dissolving the above-mentioned respective components such as 2-methoxyethanol, 2-methoxyethyl acetate, propylene glycol methyl ethyl acetate, methyl lactate, ethyl lactate, propylene glycol monomethyl ether, ethanol, methyl ethyl ketone, N,N-dimethylformamide, N,N-dimethylacetamide, tetrahydrofuran and dioxane, and the resulting solutions are applied onto supports. These solvents are used alone or as mixtures thereof. The amount thereof coated is suitably within the range of 0.05 $g/m^2$ to 10 $g/m^2$, and preferably within the range of 0.1 $g/m^2$ to 5 $g/m^2$, by weight after drying. Too thick the light-heat conversion layers gives unfavorable results such as a reduction in laser recording sensitivity.

The waterless lithographic printing plates of the present invention are required to have such flexibility that they can be set on usual printers and to withstand the loading imposed in printing. Accordingly, typical examples of the supports include coat paper, plates of metals such as aluminum, films of plastics such as polyethylene terephthalate, rubber and composite materials thereof, and more preferably plates of aluminum, plates of aluminum alloys (for example, alloys of aluminum and metals such as silicon, copper, manganese, magnesium, chromium, zinc, lead, bismuth and nickel) and plastic films.

The thickness of the support is suitably 25 $\mu$m to 3 mm, and preferably 75 $\mu$m to 500 $\mu$m. However, the optimum thickness varies depending on the kind of support used and printing conditions. Generally, it is most preferably from 100 $\mu$m to 300 $\mu$m.

In the present invention, primer layers can be provided between the supports and the light-heat conversion layers. Various kinds of primer layers can be used for improving the adhesion between the supports and the light-heat conversion layers and the printing characteristics. Examples thereof include layers of various light-sensitive polymers which are exposed to harden them before lamination of the light-sensitive resin layers disclosed in JP-A-60-22903, heat-hardened epoxy resin layers disclosed in JP-A- 62-50760, hardened gelatin layers disclosed in JP-A-63-133151, layers formed by use of urethane resins and silane coupling agents disclosed in JP-A-3-200965, and urethane resin layers disclosed in JP-A-3-273248. In addition, hardened casein layers are also effective.

For the purpose of making the primer layers flexible, polymers having glass transition temperatures of room temperature or less, such as polyurethanes, polyamides, styrene/butadiene rubber, carboxy-modified styrene/butadiene rubber, acrylonitrile/butadiene rubber, carboxy-modified acrylonitrile/butadiene rubber, polyisoprene, acrylate rubber, polyethylene, chlorinated polyethylene and chlorinated polypropylene, may be added to the above-mentioned primer layers. They may be added in any amount, and the primer layers may be formed of the additives alone as long as the film layers can be formed. In accordance with the above-mentioned purposes, the primer layers can contain additives such as dyes, pH indicators, printing-out agents, photopolymerization initiators, adhesive auxiliaries (for example, polymerizable monomers, diazo resins, silane coupling agents, titanate coupling agents and aluminum coupling agents), pigments, silica powder and titanium oxide powder. Further, the primer layers can also be hardened by exposure after coating. In general, the amount of the primer layers coated is suitably 0.1 $g/m^2$ to 10 $g/m^2$, preferably 0.3 $g/m^2$ to 8 $g/m^2$, and more preferably 0.5 $g/m^2$ to 5 $g/m^2$, by dry weight.

In the waterless lithographic printing plates of the present invention using the light-heat conversion layers, the laser beam energy used in recording is absorbed by the light-heat conversion layers of the waterless lithographic printing plates of the present invention, and converted to the heat energy. This causes a reaction or a physical change such as combustion, fusion, decomposition, vaporization or explosion (abrasion), resulting in deterioration of the adhesion between the light-heat conversion layers and the silicone rubber layers.

In this case, laser beams are used for exposure of the waterless lithographic printing plates. There is no particular limitation on lasers used, as long as they give the exposure necessary for a reduction in the adhesion sufficient for peeling or removing the silicone rubber layers. Such lasers include gas lasers such as an Ar laser and a carbon dioxide laser, solid lasers such as a YAG laser, and semiconductor lasers. Usually, lasers having an output of 50 mW or more are required. From the practical points of view of maintenance and cost, the semiconductor lasers and semiconductor-excited solid lasers (such as the YAG laser) are preferably used.

The recording wavelength of these lasers are in the region of the wavelength of infrared rays, and an oscillation wavelength of 800 nm to 1100 nm is frequently used.

The plates may be exposed to laser beams either with the films for surface protection of the silicone rubber layers remaining as such, or after peeling thereof.

Further, in the present invention, a layer obtained by applying a coating solution containing (a) a compound having at least two groups selected from enol ether groups represented by formula (I) and enol thioether groups represented by formula (II), (b) a linear polymer having an acid group and a hydroxyl or mercapto group and (c) a compound generating an acid by irradiation of an active light ray or a radiant ray, and heating it at 60° C. to 150° C. for 30 seconds to 10 minutes can be used as the light-sensitive layer.

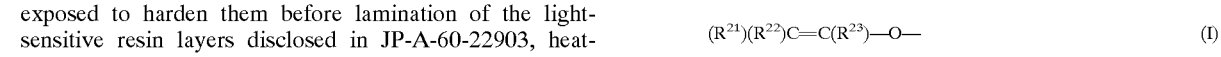

$$(R^{21})(R^{22})C{=}C(R^{23})\text{—}O\text{—} \quad (I)$$

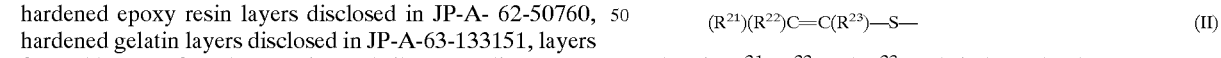

$$(R^{21})(R^{22})C{=}C(R^{23})\text{—}S\text{—} \quad (II)$$

wherein $R^{21}$, $R^{22}$ and $R^{23}$ each independently represents a hydrogen atom, an alkyl group or an aryl group, and two of them may combine to form a saturated or olefinic unsaturated ring.

In the above-mentioned light-sensitive layer, the enol ether or enol thioether group-containing compound of component (a) and the linear polymer of component (b) thermally form a three-dimensional crosslinking structure.

First, the enol ether or enol thioether group-containing compound of component (a) used in the present invention will be described below.

When $R^{21}$, $R^{22}$ and $R^{23}$ in the enol ether group of formula (I) and the enol thioether group of formula (II) are aryl groups, they each generally has 6 to 20 carbon atoms (for example, phenyl, naphthyl, anthryl and phenanthryl), and may each be substituted by alkyl, alkoxy, aryloxy, acyl acyloxy, alkylmercapto, amino, aminoacyl, carboalkoxy, nitro, sulfonyl, cyano or halogen.

When $R^{21}$, $R^{22}$ and $R^{23}$ each represents an alkyl group, they each represents a saturated or unsaturated straight, branched or alicyclic alkyl group preferably having 1 to 20 carbon atoms (for example, methyl, ethyl, propyl, isopropyl or cyclohexyl), and may each be substituted by halogen, cyano, ester, alkoxy, aryloxy or aryl. Further, when any two of $R^{21}$, $R^{22}$ and $R^{23}$ combine to form a cycloalkyl group or a cycloalkenyl group, they usually represent 3- to 8-membered rings, and preferably 5- and 6-membered rings.

In the present invention, of the enol ether groups of formula (I) and the enol thioether groups of formula (II), preferred is an enol ether or enol thioether group in which one of $R^{21}$, $R^{22}$ and $R^{23}$ is methyl or ethyl, and the others are hydrogen atoms. More preferred is a vinyl ether or vinyl thioether group in which $R^{21}$ $R^{22}$ and $R^{23}$ are all hydrogen atoms.

In the present invention, various compounds each containing at least two groups selected from enol ether and enol thioether groups can be used. They are preferably compounds having a boiling point of at least 60° C. at atmospheric pressure.

Preferred examples of compounds used as component (a) include enol ether or enol thioether compounds represented by formula (III) or (IV):

$$A—[—(O—R^{24})_n—X—CH{=}CH_2]_m \quad (III)$$

$$A—[—B—R^{24}—X—CH{=}CH_2]_m \quad (IV)$$

wherein A represents an alkylene group, an arylene group or a heterocyclic group, with m-valency; B represents —CO—O—, —NHCOO—or —NHCONH—; $R^{24}$ represents a straight or branched chain alkylene group having 1 to 10 carbon atoms; X represents an oxygen atom or a sulfur atom; n is an integer of 0 or 1 to 10; and m represents an integer of 2 to 6.

The compounds represented by formula (III) can be synthesized by, for example, a method described in Stephen and C. Lapin, *Polymers Paint Colour Journal,* 179 (4237), 321 (1988), that is, based on the reaction of polyhydric alcohols or polyhydric phenols with acetylene, or the reaction of polyhydric alcohols or polyhydric phenols with alkyl vinyl ether halides.

Specific examples of the enol ether compounds represented by formula (III) include, but are not limited to, ethylene glycol divinyl ether, triethylene glycol divinyl ether, 1,3-butanediol divinyl ether, tetramethylene glycol divinyl ether, neopentyl glycol divinyl ether, trimethylolpropane trivinyl ether, trimethylolethane trivinyl ether, hexanediol divinyl ether, 1,4-cyclohexanediol divinyl ether, tetraethylene glycol divinyl ether, pentaerythritol divinyl ether, pentaerythritol trivinyl ether, pentaerythritol tetravinyl ether, sorbitol tetravinyl ether, sorbitol pentavinyl ether, ethylene glycol diethylene vinyl ether, triethylene glycol diethylene vinyl ether, ethylene glycol dipropylene vinyl ether, triethylene glycol diethylene vinyl ether, trimethylolpropane triethylene vinyl ether, trimethylolpropane diethylene vinyl ether, pentaerythritol diethylene vinyl ether, pentaerythritol triethylene vinyl ether, pentaerythritol tetraethylene vinyl ether, 1,2-di(vinyl ether methoxy) benzene, 1,2-di(vinyl ether ethoxy) benzene and compounds represented by formulas (III-1) to (III-41) described in JP-A-8-328240.

Specific examples of the enol thioether compounds represented by formula (III) include, but are not limited to, ethylene glycol divinyl thioether, triethylene glycol divinyl thioether, 1,3-butanediol divinyl thioether, tetramethylene glycol divinyl thioether, neopentyl glycol divinyl thioether, trimethylolpropane trivinyl thioether, trimethylolethane trivinyl thioether, hexanediol divinyl thioether, 1,4-cyclohexanediol divinyl thioether, tetraethylene glycol divinyl thioether, pentaerythritol tetravinyl thioether, sorbitol tetravinyl thioether, sorbitol pentavinyl thioether, ethylene glycol diethylene vinyl thioether, triethylene glycol diethylene vinyl thioether, ethylene glycol dipropylene vinyl thioether, trimethylol-propane triethylene vinyl thioether, trimethylolpropane diethylene vinyl thioether, pentaerythritol diethylene vinyl thioether, pentaerythritol triethylene vinyl thioether, 1,2-di(vinyl ether methoxy)benzene, 1,2-di (vinyl thioether ethoxy)benzene and compounds represented by formulas (III-42) to (III-57) described in JP-A-8-328240.

On the other hand, the compounds represented by formula (IV) (when B is —CO—O—) can be produced by the reaction of multifunctional carboxylic acids with alkyl vinyl ether halides. Specific examples of such compounds include, but are not limited to, diethylene vinyl ether terephthalate, diethylene vinyl ether phthalate, diethylene vinyl ether isophthalate, dipropylene vinyl ether phthalate, dipropylene vinyl ether terephthalate, dipropylene vinyl ether isophthalate, diethylene vinyl ether maleate, diethylene vinyl ether fumarate, diethylene vinyl ether itaconate, diethylene vinyl thioether terephthalate, diethylene vinyl thioether phthalate, diethylene vinyl thioether isophthalate, dipropylene vinyl thioether phthalate, dipropylene vinyl thioether terephthalate, dipropylene vinyl thioether isophthalate, diethylene vinyl thioether maleate, diethylene vinyl thioether fumarate and diethylene vinyl thioether itaconate.

Further, the vinyl ether or vinyl thioether group-containing compounds preferably used in the present invention include vinyl ether or vinyl thioether group-containing compounds synthesized by the reaction of vinyl ether or vinyl thioether compounds having active hydrogen represented by formulas (V), (VI) and (VII) with compounds having isocyanate groups.

$$CH_2{=}CH—X—R^{25}—OH \quad (V)$$

$$CH_2{=}CH—X—R^{25}—COOH \quad (VI)$$

$$CH_2{=}CH—X—R^{25}—NH_2 \quad (VII)$$

wherein $R^{25}$ represents a straight or branched chain alkylene group having 1 to 10 carbon atoms; and X represents an oxygen atom or a sulfur atom. As the isocyanate group-containing compounds, for example, compounds described in *Handbook of Crosslinking Agents* published by Taiseisha (1981) can be used.

Specific examples thereof include polyisocyanate type compounds such as triphenylmethane triisocyanate, diphenylmethane diisocyanate, tolylene diisocyanate, a dimer of 2,4-tolylene diisocyanate, naphthalene-1,5-diisocyanate, o-tolylene diisocyanate, polymethylenepolyphenyl isocyanate and hexamethylene diisocyanate, and polyisocyanate adduct type compounds such as an adduct of tolylene diisocyanate and trimethylolpropane, an adduct of hexamethylene diisocyanate and water, and an adduct of xylene diisocyanate and trimethylolpropane.

Various compounds having vinyl ether or vinyl thioether groups at their ends by reacting the above-mentioned isocyanate group-containing compounds with the compounds having active hydrogen-containing vinyl ether or vinyl thioether groups. Examples of such compounds include compounds represented by formulas (V-1) to (V-20) described in JP-A-8-328240, but the scope of the invention is not limited thereto.

The compounds having at least two groups selected from enol ether and enol thioether groups described above may be used either alone or as a mixture of several kinds of them.

The above-mentioned enol ether or enol thioether group-containing compound used in the present invention and the linear polymer which can be thermally crosslinked are dissolved in a coating solvent, applied and heated during or after drying, thereby obtaining a resin having a crosslinking structure which is hydrolyzable in the presence of an acid. In this case, the amount of the enol ether and/or enol thioether group-containing compound added is from 1 to 80% by weight, preferably from 3 to 50% by weight, and more preferably from 5 to 30% by weight, based on the total solid content of light-sensitive components. Addition of a smaller amount of the enol ether or enol thioether group-containing compound results in insufficient crosslinking ability, so that ON/OFF of an image (i.e., difference between soluble resistance of the exposed area and solubility of the unexposed area in the light-sensitive layer against the developer) is decreased. On the other hand, addition of a larger amount of it results is a reduction in sensitivity.

Then, the acid group-containing linear polymers (b) which thermally react with the enol ether or enol thioether group-containing compounds to form three-dimensionally crosslinked resins will be described below.

The linear polymer (b) having an acid group and a hydroxyl or mercapto group used in the present invention can be arbitrarily selected for use, as long as it thermally reacts with the compound having at least two groups selected from enol ether and enol thioether group (component (a)), and the resulting crosslinked portion is efficiently decomposed with an acid. In this case, the acid group can also serve as the crosslinking group.

Generally, the above-mentioned linear polymers can be synthesized by well-known methods for obtaining linear polymers. For example, the linear polymers can be obtained by copolymerizing vinyl monomers having acid groups (preferably, carboxylic acid groups, sulfonic acid groups, phosphoric acid groups or sulfonamido groups) with other vinyl monomers copolymerizable therewith (preferably, vinyl monomers having hydroxyl or mercapto groups).

Examples of the acid group-containing vinyl monomers include, but are not limited to, acrylic acid, methacrylic acid, maleic acid, itaconic acid, crotonic acid, isocrotonic acid, p-vinylbenzoic acid, p-vinylbenzenesulfonic acid, p-vinylcinnamic acid, monomethyl ether maleate, monoethyl ether maleate and 2-(acrylamido)-2-methylpropanesulfonic acid.

Examples of the other monomers copolymerizable with the above-mentioned monomers include acrylonitrile, acrylamide, methacrylamide, methyl acrylate, ethyl acrylate, propyl acrylate, butyl acrylate, methyl methacrylate, ethyl methacrylate, propyl methacrylate, butyl methacrylate, benzyl acrylate, benzyl methacrylate, vinyl benzoate, vinyl chloride, vinylidene chloride, styrene, vinyl acetate, N-(4-sulfamoylphenyl)methacrylamide, N-phenylphosphonylmethacryl amide, butadiene, chloroprene, isoprene, 2-hydroxyethyl acrylate, 2-hydroxyethyl methacrylate, p-2-hydroxyethylstyrene, p-hydroxystyrene, 3-mercaptoethyl acrylate and 2-mercaptoethyl methacrylate.

The acid-containing vinyl monomers and the other copolymerizable monomers can be copolymerized in any combinations of any kinds of monomers. However, the ratio of the acid-containing vinyl monomers to the other copolymerizable monomers is suitably from 2:98 to 80:20, preferably from 5:95 to 70:30, and more preferably from 5:95 to 30:70, by weight percent.

Further, the linear polymers (b) having acid groups and hydroxyl or mercapto groups can be obtained by the reaction of acid group-containing dihydroxy compounds with diisocyanate compounds, or the copolycondensation of acid group-containing dihydroxy compounds with dicarboxylic acid compounds. For example, carboxyl group-containing linear polyurethane resins are obtained by reacting acid group-containing dihydroxy compounds such as 3,5-dihydroxybenzoic acid, 2,2-bis(hydroxymethyl)propionic acid, 2,2-bis(2-hydroxyethyl)propionic acid, 2,2-bis(3-hydroxypropyl)-propionic acid, bis(hydroxymethyl)acetic acid, bis(4-hydroxyphenyl)acetic acid, 4,4-bis(4-hydroxyphenyl)pentanoic acid and tartaric acid with isocyanate compounds such as 2,4-tolylene diisocyanate, a dimer of 2,4-tolylene diisocyanate, 4,4'-diphenylmethane diisocyanate, 1,5-naphthylene diisocyanate, hexamethylene diisocyanate, trimethylhexamethylene diisocyanate and 4,4'-methylenebis(cyclohexyl isocyanate), in the same equivalent. Further, diol compounds which have no carboxyl groups and may have other substituent groups unreactive to isocyanates may be used in combination. Examples thereof include, but are not limited to, ethylene glycol, diethylene glycol, triethylene glycol, neopentyl glycol, 1,3-butylene glycol, bisphenol A, hydrogenated bisphenol A, hydrogenated bisphenol F and an ethylene oxide adduct of bisphenol A.

Furthermore, the linear polymers (b) can be obtained by the copolycondensation of the above-mentioned acid group-containing diols, and the above-mentioned other diols if necessary, with difunctional carboxylic acids such as phthalic acid, isophthalic acid, terephthalic acid, fumaric acid, itaconic acid and adipic acid.

The ratio of the acid-containing diols to the other monomer units is suitably from 2:98 to 80:20, preferably from 5:95 to 70:30, and more preferably from 5:95 to 30:70, by weight percent.

The linear polymers (b) having acid groups and hydroxyl or mercapto groups used in the present invention include resins containing phenolic hydroxyl groups. Specific examples thereof include, but are not limited to, novolak resins such as phenol-formaldehyde resins, m-cresol-formaldehyde resins, p-cresol-formaldehyde resins, o-cresol-formaldehyde resins, m-/p-cresol(mixed)-formaldehyde resins and phenol/cresol-formaldehyde resins, resol type phenol resins, phenol-modified xylene resins, polyhydroxystyrene, polyhydroxy-styrene halide and acrylic resins having phenolic hydroxyl groups.

The molecular weight of these linear polymers is from 1,000 to 1,000,000, and preferably from 1,500 to 200,000. Too low a molecular weight results in deteriorated crosslinking ability, whereas too high results in a reduction in sensitivity.

Of these, copolymers comprising the acid-containing monomers and the hydroxyl or mercapto group-containing monomers at a specified ratio are preferably used as the linear polymers. The linear polymers are particularly preferred in which the amount of the acid-containing monomers contained in the copolymers is from 5 to 50% by weight, preferably from 5 to 40% by weight, and more preferably from 10 to 30% by weight, and the amount of the hydroxyl or mercapto group-containing monomers contained therein is from 5 to 50% by weight, preferably from 5 to 40% by weight, and more preferably from 10 to 30% by weight.

In the present invention, the linear polymers may be either used alone or as a mixture of several kinds of them. The amount of the linear polymers added to the light-sensitive compositions is from 1 to 95% by weight, preferably from 20 to 90% by weight, and more preferably from 30 to 80% by weight. Too small an amount of the linear polymers added results in a reduction in sensitivity, whereas too large an amount results in insufficient crosslinking ability.

As compounds used in the present invention which are decomposed by irradiation of active light rays or radiant rays to generate acids (hereinafter occasionally referred to as light acid generating agents), photoinitiators for cationic photopolymerization, photoinitiators for radical photopolymerization, decoloring agents and discoloring agents for dyes, well-known compounds generating acids by light which are used in microresists and mixtures thereof can be appropriately selected for use.

Examples thereof include onium salts such as diazonium salts described in S. I. Schlesinger, *Photogr. Sci. Eng.,* 18 , 387 (1974) and T. S. Bal et al., *Polymer,* 21, 423 (1980), ammonium salts described in U.S. Pat. Nos. 4,069,055, 4,069,056 and Re 27,992 and JP-A-4-365049, phosphonium salts described in D. C. Necker et al., *Macromolecules,* 17, 2468 (1984), C. S. Wen et al., *Teh. Proc. Conf. Rad. Curing ASIA,* page 478, Tokyo, Oct. (1988), U.S. Pat. Nos. 4,069,055 and 4,069,056, iodonium salts described in J. V. Crivello et al., *Macromolecules,* 10(6), 1307 (1977), *Chem. & Eng. News*, November 28, page 31 (1988), European Patent 104,143, U.S. Pat. Nos. 339,049 and 410,201, JP-A-2-150848 and JP-A-2-296514, sulfonium salts described in J. V. Crivello et al., *Polymer J.,* 17, 73 (1985), J. V. Crivello et al., *J. Org. Chem.,* 43, 30505 (1978), W. R. Watt et al, *J. Polymer Sci., Polymer Chem. Ed.,* 22, 1789 (1984), J. V. Crivello et al., *Polymer Bull.,* 14, 279 (1985), J. V. Crivello et al., *Macromolecules,* 14(5), 1141 (1981), J. V. Crivello et al., *J. Polymer Sci., Polymer Chem. Ed.,* 17, 2877 (1979), European Patents 370,693, 233,567, 297,443 and 297,442, U.S. Pat. Nos. 4,933,377, 3,902,114, 339,049, 4,760,013, 4,734,444 and 2,833,827, German Patents 2,904,626, 3,604, 580 and 3,604,581, selenonium salts described in J. V. Crivello et al., *Macromolecules,* 10(6), 1307 (1977) and J. V. Crivello et al., *J. Polymer Sci., Polymer Chem. Ed.,* 17, 1047 (1979), and arsonium salts described in C. S. Wen et al., *Teh. Proc. Conf. Rad. Curing ASIA,* page 478, Tokyo, October (1988); organic halogen compounds described in U.S. Pat. No. 3,905,815, JP-B-46-4605, JP-A-48-36281, JP-A-55-32070, JP-A-60-239736, JP-A-61-169835, JP-A-61-169837, JP-A-62-58241, JP-A-62-212401, JP-A-63-70243 and JP-A-63-298339; organic metal/organic halogen compounds described in K. Meier et al., *J. Rad. Curing,* 13(4), 26 (1986), T. P. Gill et al., *Inorg. Chem.,* 19, 3007 (1980), D. Astruc, *Acc. Chem. Res.,* 19(12), 377 (1896) and JP-A-2-161445; light acid generating agents having o-nitrobenzyl type protective groups described in S. Hayase et al., *J. Polymer Sci.,* 25, 753 (1987), E. Reichmanis et al., *J. Polymer Sci., Polymer Chem. Ed.,* 23, 1 (1985), Q. Q. Zhu et al., *J. Photochem.,* 36, 85, 39, 317 (1987), B. Amit et al., *Tetrahedron Lett.,* (24), 2205 (1973), D. H. R. Barton et al., *J. Chem. Soc.,* 3571 (1965), P. M. Collins et al., *J. Chem. Soc.,* Perkin I, 1695 (1975), M. Rudinstein et al., *Tetrahedron Lett.,* (17), 1445 (1975), J. W. Walker et al., *J. Am. Chem. Soc.,* 110, 7170 (1988), S. C. Busman et al., *J. Imaging Technol.,* 11(4), 191 (1985), F. M. Houlihan et al., *Macromolecules,* 21, 2001 (1988), P. M. Collins et al., *J. Chem. Soc.,* Chem. Commun., 532 (1972), S. Hayase et al., *Macromolecules,* 11, 1799 (1985), E. Reichmanis et al., *J. Electrochem. Soc., Solid State Sci. Technol.,* 130 (6), F. M. Houlihan et al, *Macromolecules,* 21, 2001 (1988), European Patents 0,290,750, 046,083, 156,535, 271,851 and 0,388, 343, U.S. Pat. Nos. 3,901,710 and 4,181,531, JP-A-60-198538 and JP-A-53-133022; compounds which are photodecomposed to generate sulfonic acid, represented by iminosulfonates, described in M. Tunooka et al., *Polymer Preprints, Japan,* 38(8), G. Berner et al., *J. Rad. Curing,* 13(4), W. J. Mijs et al., *Coating Technol.,* 55(697), 45 (1983), H. Adachi et al., *Polymer Preprints. Japan,* 37(3), European Patents 199,672, 84,515, 044,115 and 0,101,122, U.S. Pat. Nos. 4,618,564, 4,371,605 and 4,431,774, JP-A-64-18143, JP-A-2-245756 and JP-A-4-365048; disulfone compounds described in JP-A-61-166544; and o-naphthoquinone diazide compounds described in G. Buhr et al, SPIE(1086), 117(1989), R. Hayase et al, *J. Photopolymer Sci. Technol.,* 6(4), 495(1993), JP-A-53-8128 and JP-A-8-76380.

Further, compounds in which these acid-generating groups or compounds are introduced into main chains or side chains of polymers, for example, compounds generating acids by light which are described in M. E. Woodhouse et al., *J. Am. Chem. Soc.,* 104, 5586 (1982), S. P. Pappas et al., *J. Imaging Sci.,* 30(5), 218 (1986), S. Kondo et al., *Makromol. Chem., Rapid Commun.,* 9625 (1988), Y. Yamada et al., *Makromol. Chem.,* 152, 153, 163 (1972), J. V. Crivello et al., *J. Polymer Sci., Polymer Chem. Ed.,* 17, 3845 (1979), U.S. Pat. No. 3,849,137, German Patent 3,914,407, JP-A-63-26653, JP-A-55-164824, JP-A-62-69263, JP-A-63-1460387, JP-A-63-163452, JP-A-62-153853 and JP-A-63-146029 can be used.

Further, compounds generating acids with light described in V. N. R. Pillai, *Synthesis,* (1), 1 (1980), A. Abad et al., *Tetrahedron Lett.,* (47), 4555 (1971), D. H. R. Barton et al., *J. Chem. Soc.,* (C), 329 (1970), U.S. Pat. No. 3,779,778 and European Patent 126,712 can also be used.

Of the above-mentioned compounds which are decomposed by irradiation of active light rays or radiant rays to generate acids, ones particularly effectively used are described below.

(1) Oxazole derivatives represented by formula (VIII) in which trihalomethyl groups are substituted, or S-triazine triazine derivatives represented by formula (IX):

(VIII)

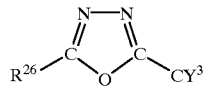

(IX)

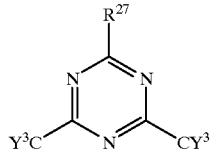

wherein $R^{26}$ represents a substituted or unsubstituted aryl or alkenyl group, and $R^{27}$ represents a substituted or unsubstituted aryl, alkenyl or alkyl group, or —$CY_3$, wherein Y represents a chlorine atom or a bromine atom.

Specific examples of the above-mentioned oxazole derivatives (VIII) and S-triazine derivatives (IX) include, but are not limited to, compounds (VIII-1) to (VIII-8) and compounds (IX-1) to (IX-10) described in JP-A-8-328240.

(2) Iodonium salts represented by formula (X) or sulfonium salts represented by formula (XI):

(X)

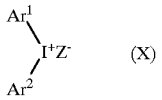

(XI)

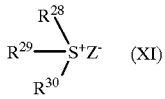

wherein $Ar^1$ and $Ar^2$ each independently represents a substituted or unsubstituted aryl group. Preferred examples of the substituent groups include alkyl, haloalkyl, cycloalkyl, aryl, alkoxyl, nitro, carboxyl, alkoxycarbonyl, hydroxyl, mercapto and halogen atoms.

$R^{28}$, $R^{29}$, and $R^{30}$ each independently represents a substituted or unsubstituted alkyl or aryl group, and preferably an aryl group having 6 to 14 carbon atoms, an alkyl group having 1 to 8 carbon atoms or a substituted derivative thereof. Preferred examples of the substituent groups include alkoxyl having 1 to 8 carbon atoms, alkyl having 1 to 8 carbon atoms, nitro, carboxyl, hydroxyl and halogen atoms for the aryl groups, and alkoxyl having 1 to 8 carbon atoms, carboxyl and alkoxycarbonyl for the alkyl groups.

$Z^-$ represents a counter anion, and examples thereof include, but are not limited to, $BF_4^-$, $AsF_6^-$, $PF_6^-$, $SbF_6^-$, $SiF_6^-$, $ClO_4^-$, $CF_3SO^-$, $BPh_4^-$ (Ph=phenyl), condensed polynuclear aromatic sulfonic acid anions such as a naphthalene-l-sulfonic acid anion and an anthraquinone-sulfonic acid anion, and sulfonic acid group-containing dyes.

Further, two of $R^{28}$, $R^{29}$ and $R^{30}$, or $Ar^1$ and $Ar^2$ may each combine through a single bond or a substituent group.

The above-mentioned onium salts represented by formulas (X) and (XI) are well-known, and can be synthesized by, for example, methods described in J. W. Knapczyk et al., *J. Am. Chem. Soc.,* 91, 145 (1969), A. L. Maycok et al., *J. Org. Chem.,* 35, 2532 (1970), E. Goethas et al., *Bul. Soc. Chem. Belg.,* 73, 546 (1964), H. M. Leicester, *J. Am. Chem. Soc.,* 51, 3587 (1929), J. B. Crivello et al., *J. Polym. Chem. Ed.,* 18, 2677 (1980), U.S. Pat. Nos. 2,807,648 and 4,247,473 and JP-A-53-101331.

Specific examples of the onium salts represented by formulas (X) and (XI) include, but are not limited to, compounds (X-1) to (X-20) and compounds (XI-1) to (XI-34) described in JP-A-8-328240.

(3) Disulfone derivatives represented by formula (XII) or iminosulfonate derivatives represented by formula (XIII):

(XIII)

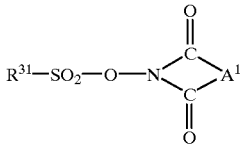

wherein $Ar^3$ and $Ar^4$ each independently represents a substituted or unsubstituted aryl group, $R^{31}$ represents a substituted or unsubstituted alkyl or aryl group, and $A^1$ represents a substituted or unsubstituted alkylene, alkenylene or arylene group.

Specific examples of the onium salts represented by formulas (XII) and (XIII) include, but are not limited to, compounds (XII-1) to (XII-12) and compounds (XIII-1) to (XIII-12) described in JP-A-8-328240.

(4) o-Naphthoquinone diazide compounds represented by formula (XIV):

(XIV)

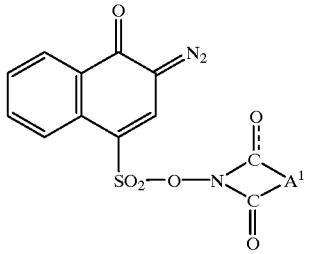

wherein $A^2$ represents a divalent substituted or unsubstituted aliphatic residue, or a divalent substituted or unsubstituted aromatic residue.

Specific examples of the compounds represented by formula (XIV) include, but are not limited to, compounds (XIV-1) to (XIV-24) described in JP-A-8-328240.

The compounds which are decomposed by irradiation of active light rays or radiant rays to generate acids are added usually in an amount of 0.001 to 40% by weight, preferably in an amount of 0.1 to 20% by weight, more preferably in an amount of 0.2 to 10% by weight, based on the total solid content of the light-sensitive compositions. Too low an amount of the acid-generating compounds added results in a reduction in sensitivity, whereas too large an amount results in failure to increase the sensitivity higher than a definite value to cause increased cost.

In the present invention, the light-sensitive layer compositions can contain various well-known compounds such as compounds (sensitizers) for enhancing the light acid generating efficiency of the above-mentioned acid-generating compounds, dyes, pigments and plasticizers, if necessary.

Examples of the sensitizers which can be used in the present invention include, but are not limited to, electron-donating compounds such as pyrene and perylene, merocyanine dyes and cyanine dyes. The ratio of these sensitizers to the above-mentioned components (b) preferably ranges from 0.01/1 to 20/1 in molar ratio, and from 0.1/1 to 5/1 in weight ratio.

In the present invention, dyes can be used as colorants in the light-sensitive compositions, and preferred examples of the dyes are oil-soluble dyes or basic dyes. Specific examples thereof include Oil Yellow #101, Oil Yellow #130, Oil Pink #312, Oil Green BG, Oil Blue BOS, Oil Black BY, Oil Black BS and Oil Black T-505 (the above dyes are manufactured by Oriental Kagaku Kogyo Corp.), Crystal Violet (CI42555), Methyl Violet (CI42535), Rhodamine B (CI45170B), Malachite Green (CI42000) and Methylene Blue (CI52015).

These dyes can be added to the light-sensitive compositions in an amount of 0.01 to 10% by weight, preferably in an amount of 0.1 to 3% by weight, based on the total solid content of the light-sensitive compositions.

Further, in order to enhance the adhesive property to the silicone rubber layers, silane coupling agents or titanium coupling agents may be added in small amounts. For improving the coating properties, silicone surfactants, fluorine surfactants and fluorine surface-orienting agents may be added.

The light-sensitive compositions used in the present invention are dissolved in solvents capable of dissolving the above-mentioned respective components for coating, and the resulting solutions are used for coating. Examples of the solvents used herein include ethylene dichloride, cyclohexanone, methyl ethyl ketone, methanol, ethanol, propanol, ethylene glycol monomethyl ether, 1-methoxy-2-propanol, ethylene glycol monoethyl ether, 2-methoxyethyl acetate, 1-methoxy-2-propyl acetate, dimethoxyethane, methyl lactate, ethyl lactate, N,N-dimethylacetamide, N,N-dimethylformamide, tetramethylurea, N-methylpyrrolidone, dimethyl sulfoxide, sulfolane, y-butyrolactone, toluene, ethyl acetate and dioxane. These solvents may be used alone or as mixtures thereof.

The concentration of the above-mentioned components (the total solid content including additives) in the solvents is preferably from 2 to 50% by weight. Further, the amount coated is generally preferably from 0.2 to 5.0 g/m$^2$, and more preferably from 0.3 to 3.0 g/m$^2$, as the solid content.

The light-sensitive layers containing the above-mentioned components (a) to (c) can be provided on supports similar to those used for the above-mentioned light-heat conversion layers. Further, primer layers can be provided between the supports and the light-sensitive layers, similar to the case with the light-heat conversion layers. Specific examples of the primer layers are as described above.

The supports are coated with the above-mentioned coating solutions by use of well-known coating techniques. Examples of the coating techniques include rotating coating, wire bar coating, dip coating, air knife coating, roll coating, blade coating, curtain coating and spray coating.

The layers of the light-sensitive compositions applied as described above are dried by use of hot air dryers or infrared ray dryers at 40 to 150° C. for 30 seconds to 10 minutes. Component (a) is crosslinked with component (b) by a method of applying heat in coating and drying of the light-sensitive composition or a method of applying heat after coating and drying. The heating is carried out at 60 to 150° C., preferably 80 to 130° C., for 5 seconds to 20 minutes, preferably 20 seconds to 5 minutes.

In the lithographic printing plates requiring no fountain solution of the present invention in which the light-sensitive layers containing the above-mentioned components (a) to (c) are used, crosslinking of the acetal structure or the thioacetal structure is formed by heating in coating and drying, or after coating and drying to produce three-dimensionally crosslinked resins. Accordingly, the crosslinked portions are efficiently hydrolyzed in the presence of acids generated from the light acid generating agents, thereby improving the peeling property of the silicone rubber layers at exposed areas. The lithographic printing plates of the present invention are therefore excellent in sensitivity and developing properties.

On the other hand, when previously three-dimensionally crosslinked before coating, the resins are dissolved in the coating solutions with difficulty. Accordingly, the resins can not be applied well onto the supports. The lithographic printing plates of the present invention can therefore have both the easy production and the performances as the light-sensitive lithographic printing plates as described above.

The light-sensitive lithographic printing plates requiring no fountain solution of the present invention in which the light-sensitive layers containing the above-mentioned components (a) to (c) are used are usually subjected to image exposure and development. Examples of light sources of active light rays used for the image exposure include mercury lamps, metal halide lamps, xenon lamps, chemical lamps and carbon arc lamps. Radiant rays can also be used, and examples thereof include electron beams, X-rays, ion beams and far ultraviolet rays. Further, g-rays, i-rays and deep-UV light rays used as light sources for photoresists can also be used. Furthermore, scanning exposure by use of high density energy beams (laser beams or electron beams) can also be used. Examples of such laser beams include helium-neon laser beams, argon laser beams, krypton ion laser beams, helium-cadmium laser beams and KrF eximer laser beams.

The light-sensitive lithographic printing plates requiring no fountain solution having the light-sensitive layers (including the light-heat conversion layers) according to the present invention are exposed through transparent original images, and then, developed with developing solutions which can partly or wholly dissolve or swell the light-sensitive layers of image areas (exposed areas), or with developing solutions which can swell the silicone rubber layers. In this case, both the light-sensitive layers of imaging areas and the silicone rubber layers formed thereon are removed, or only the silicone rubber layers are removed. This can be controlled by the power of the developing solutions.

Well-known developing solutions for waterless lithographic printing plates can be used as the developing solutions in the present invention. From the viewpoint of safety, however, aqueous solutions of water or water-soluble organic solvents mainly composed of water are preferred. Taking into account safety and inflammability, the concentration of the water-soluble solvents is desirably less than 40% by weight. Examples of the well-known solvents include aliphatic hydrocarbons (such as hexane, heptane, "Isopar E, G or H" (manufactured by EXXON Corp.), gasoline and kerosine), aromatic hydrocarbons (such as toluene and xylene), hydrocarbon halides (such as Trichlene) containing the following polar solvents and the polar solvents themselves.

Alcohols (methanol, ethanol, propanol, isopropanol, benzyl alcohol, ethylene glycol monomethyl ether, 2-ethoxyethanol, diethylene glycol monoethyl ether, diethylene glycol monohexyl ether, triethylene glycol monomethyl ether, propylene glycol monoethyl ether, dipropylene glycol monomethyl ether, polyethylene glycol monomethyl ether, propylene glycol, polypropylene glycol and tetraethylene glycol).

Ketones (acetone and methyl ethyl ketone)

Esters (ethyl acetate, methyl lactate, butyl lactate, propylene glycol monomethyl ether acetate, diethylene glycol acetate and diethyl phthalate).

Others (triethyl phosphate and tricresyl phosphate).

The above-mentioned developing solutions of the organic solvent family may further contain water, the above-mentioned solvents may be solubilized in water by use of surfactants, and the developing solutions may further contain alkali agents for example, inorganic alkali agents such as sodium silicate, potassium silicate, sodium hydroxide, potassium hydroxide, lithium hydroxide, sodium tertiary phosphate, sodium secondary phosphate, ammonium tertiary phosphate, ammonium secondary phosphate, sodium metasilicate, sodium bicarbonate and aqueous ammonia, and organic alkali agents such as tetraalkylammonium halides, monoethanolamine, diethanolamine and triethanolamine.

Further, only tap water or alkaline water can be used as the developing solutions in some cases, and surfactants or organic solvents as described above can also be added if necessary.

Furthermore, dyes such as Crystal Violet and Astrazone Red can be added to the developing solutions to conduct dyeing of image areas and development at the same time.

The development can be conducted by well-known methods such as rubbing of a plate face with a developing pad containing the developing solution as described above, and rubbing of a plate face with a developing brush after pouring of the developing solution on the plate face. The temperature of the developing solutions can be arbitrarily selected, but is preferably 10° C. to 50° C. This removes an ink-repellent layer of the image area to convert that portion to an ink-receiving portion.

In order to confirm the image forming properties of the printing plates thus obtained, the exposed image areas can be dyed with dying solutions to make them detectable. When the developing solution does not contain the dye for dyeing the exposed image area, the area is dyed with the dyeing solution after the development. Only the imaging area is dyed by softly rubbing the image area with a pad impregnated with the dyeing solution. It can be confirmed thereby whether the development is fully performed to highlight portions or not. As the dyeing solution, a solution or a dispersion is used in which one or more dyes selected from water-soluble disperse dyes, acid dyes and basic dyes are dissolved or dispersed in a solvent such as water, an alcohol, a ketone or an ether, or in a mixed solvent of two or more of them. In order to improve the dyeing property, it is also effective to add a carboxylic acid, an amine, a surfactant, a dying auxiliary, a antifoaming agent or the like.

The printing plates dyed with the dyeing solutions are preferably washed with water, followed by drying, which can inhibit the stickiness of the plate surfaces, resulting in improvement in handling characteristics of the printing plates.

When the printing plates thus treated are stored in a stack, guard sheets are preferably inserted therebetween to protect the printing plates.

It is preferred that the development processing, the dyeing processing, and the subsequent washing and drying as described above are conducted with an automatic processor. A preferred example of such an automatic processor is described in JP-A-2-220061.

It is also possible to develop the above-mentioned waterless lithographic printing plates by laminating adhesive layers with the silicone rubber layers, and thereafter, peeling the adhesive layers. As the adhesive layers, any well-known ones which can be adhered to surfaces of the silicone rubber layers can be used. Products in which these adhesive layers are provided on flexible supports are commercially available, for example, under the trade name of "Scotch Tape #851A" of Sumitomo 3M Ltd.

The present invention will be illustrated in greater detail with reference to examples below, but these are not to be construed as limiting the scope of the invention.

EXAMPLES 1 TO 4 AND COMPARATIVE EXAMPLES 1 AND 2

(Supports)

Gelatin-undercoating layer formed as primer layer on polyethylene terephthalate film having a thickness of 188 μm so as to give a dry film thickness of 0.2 μm, thereby preparing supports.

(Preparation of Carbon Black Dispersion)

The following mixed solution was dispersed with a paint shaker for 30 minutes, and then, the glass beads were filtered off to prepare a carbon black dispersion.

| | |
|---|---|
| Carbon Black (#40 manufactured by Mitsubishi Carbon Co., Ltd.) | 5.0 g |
| Crisvon 3006LV (polyurethane manufactured by Dainippon Ink and Chemicals, Inc.) | 5.8 g |
| Nitrocellulose (containing 30% of n-propanol) | 2.3 g |
| Solsperse S27000 (manufactured by ICI Corp.) | 0.4 g |
| Propylene Glycol Monomethyl Ether | 45 g |
| Glass Beads | 160 g |

(Formation of Light-Heat Conversion Layers)

The above-mentioned polyethylene terephthalate films undercoated with gelatin were each coated with the following coating solutions so as to give a dry film thickness of 1 μm, thereby forming light-heat conversion layers.

| | |
|---|---|
| Carbon Black Dispersion (described above) | 58 g |
| Polymer Compound (shown in Table 1) | 3.2 g |
| Propylene Glycol Monomethyl Ether | 45 g |

(Formation of Silicone Rubber Layer)

The following coating solution was applied onto the above-mentioned light-heat conversion layers, heated at 125° C. for 2 minutes, and dried, thereby forming an addition type silicone rubber layer having a dry film thickness of 2 μm.

| | |
|---|---|
| α,ω-Divinylpolydimethylsiloxane (the degree of polymerization: about 700) | 9.00 g |
| $(CH_3)_3—Si—O—(SiH(CH_3)—O)_8—Si(CH_3)_3$ | 0.60 g |
| Olefin-Chloroplatinic Acid | 0.08 g |
| Inhibitor $[HC{\equiv}C—C(CH_3)_2—O—Si(CH_3)_3]$ | 0.16 g |
| Isopar G (manufactured by EXXON Corp.) | 140.0 g |

The silicone rubber layer obtained as described above was laminated with a polyethylene terephthalate film having a thickness of 6 μm.

TABLE 1

| Sample | Polymer (numerals indicate copolymerization weight ratios) |
|---|---|
| Example 1 | 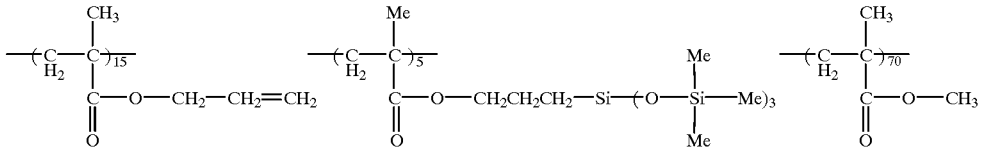 |

TABLE 1-continued

| Sample | Polymer (numerals indicate copolymerization weight ratios) |
|---|---|
| Example 2 | 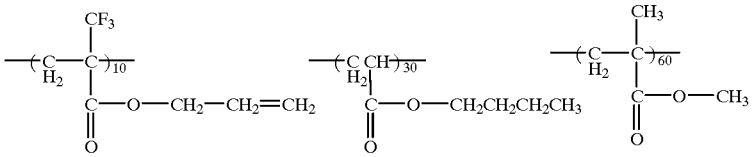 |
| Example 3 | 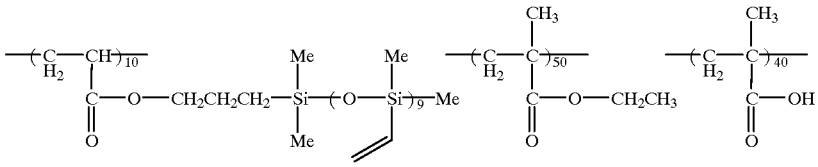 |
| Example 4 | 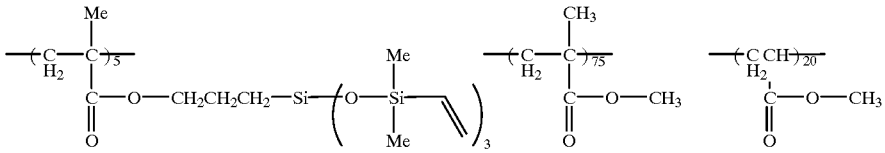 |
| Comparative Example 1 | Crisvon 3006LV |
| Comparative Example 2 | 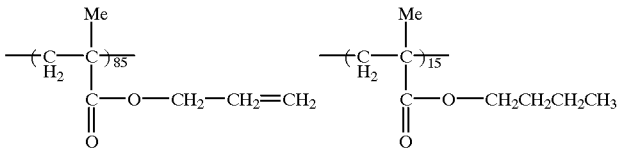 |

In each of Examples 1 to 4, after peeling the cover film from the resulting waterless printing plate of the present invention, a continuous line was written by use of a semiconductor-excited YAG laser having a wavelength of 1064 nm and a beam diameter of 22.5 $\mu$m ($1/e^2$). The recording energy was 360 mJ/cm$^2$. Then, a plate face was rubbed with a developing pad impregnated with isopropanol to remove the silicone rubber layer of a laser-exposed area. On the other hand, the silicone layer of an area not irradiated with the laser beam was not removed and maintained on the surface of the waterless printing plate, thus being able to form a silicone image having sharp edges.

Further, writing was conducted on the waterless printing plate by use of a semiconductor laser having an energy at the plate surface of 110 mW, a wavelength of 825 nm and a beam diameter of 10 $\mu$m ($1/e^2$), at a main operation speed of 6 m/second, followed by similar development. The resolving power was 8 $\mu$m, and a waterless lithographic printing plate having sharp edges was formed. Halftone dot formation of 200 lines was conducted under these recording conditions. As a result, a halftone dot area rate of 2 to 98% could be formed on the plate. A line was written on a non-image area of the resulting waterless printing plate with a 0.25-mm sapphire needle under a load of 100 g by use of a HEIDON unit (manufactured by SHINTO Scientific Co., Ltd.) to evaluate the scratch resistance of the silicone rubber layer. The waterless lithographic printing plate thus formed was printed by use of a printer, thereby obtaining 20,000 good prints free from stains.

On the other hand, writing was conducted on each of the waterless printing plates of Comparative Examples 1 and 2 by use of the semiconductor-excited YAG laser and the semiconductor laser in the same manner as with Examples 1 to 4, followed by similar development. In Comparative Example 1, however, the printing plate showed various disadvantages such as unclear edges of an image formed on the waterless printing plate and an increase in image area because of removal of the silicone at the edge portions with the progress of printing. Further, halftone dot formation of 200 lines results in only a halftone dot area rate of 4 to 96% to form the halftone dot shape with a fringe remained.

In Comparative Example 2, edges of an image formed on the waterless printing plate was sharp, but the silicone at the edge portions was removed with the progress of printing, when the plate was printed.

Furthermore, the scratch resistance was evaluated in the same manner as in Examples 1 to 4. As a result, ink adhered to an area scratched in printing to form a stain.

EXAMPLES 5 TO 8 AND COMPARATIVE EXAMPLE 3

(Formation of Supports and Light-Heat Conversion Layers)

Supports were formed in the same manner as in Examples 1 to 4 and Comparative Examples 1 and 2, and light-heat conversion layers were formed in the same manner as with Examples 1 to 4 and Comparative Examples 1 and 2 except that polymers shown in Table 2 were used in place of the polymers shown in Table 1.

(Formation of Silicone Rubber Layer)

The following coating solution was applied onto the above-mentioned light-heat conversion layers, heated at 110° C. for 1 minute, and dried, thereby forming a condensation type silicone rubber layer having a dry film thickness of 2 μm.

| | |
|---|---|
| Dimethylpolysiloxane (having hydroxyl groups at both ends) | 9.0 g |
| Methyltriacetoxysilane | 0.30 g |
| Dibutyltin Dioctanate | 0.20 g |
| Isopar G (manufactured by EXXON Corp.) | 160.0 g |

The silicone rubber layer obtained as described above was laminated with a 6-μm thick polyethylene terephthalate film.

In Comparative Example 3, the printing plate showed various disadvantages such as unclear edges of an image formed on the waterless printing plate and an increase in image area because of removal of the silicone at the edge portions with the progress of printing, when it was printed. Further, halftone dot formation of 200 lines results in only a halftone dot area rate of 4 to 96% to form the halftone dot shape with a fringe remained.

EXAMPLES 9 TO 12 AND COMPARATIVE EXAMPLE 4

Aluminum plates subjected to anodic oxidation were coated with light-sensitive solutions of the following composition so as to give a dry weight of 1.7 g/m$^2$ and then dried at 100° C. for 10 minute.

TABLE 2

| Sample | Polymer (numerals indicate copolymerization weight ratios) |
|---|---|
| Example 5 | 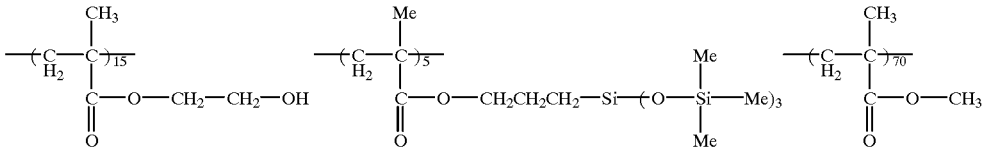 |
| Example 6 | 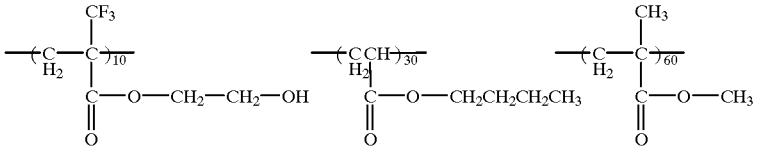 |
| Example 7 | 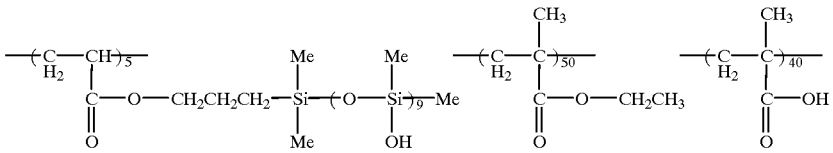 |
| Example 8 | 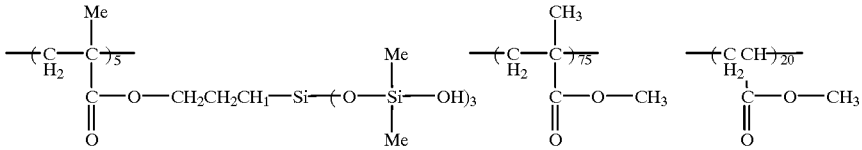 |
| Comparative Example 3 | 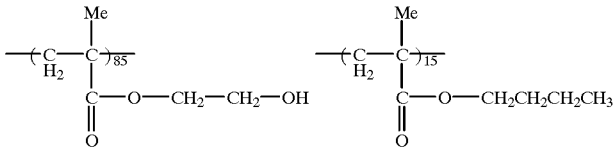 |

Writing was conducted on each of the waterless printing plates of Examples 5 to 8 and Comparative Examples 3 by use of the semiconductor-excited YAG laser and the semiconductor laser in the same manner as in Examples 1 to 4, followed by similar development. As a result, edges of an image formed on the waterless printing plate was sharp, and also in the halftone dot formation of 200 lines, a halftone dot area rate of 2 to 98% could be formed on the plate. Further, the waterless lithographic printing plate thus formed was printed by use of a printer. As a result, 20,000 good prints free from stains were obtained.

| | |
|---|---|
| Methacrylic Acid/Benzyl Methacrylate/2-Hydroxyethyl Methacrylate (20/55/25 in weight ratio, molecular weight: 43,000) | 1.8 g |
| Polymer (shown in Table 3) | 0.2 g |
| Compound A (shown below) | 0.4 g |
| Light-Acid Generating Agent (shown below) | 0.1 g |
| Dioxane | 50.0 g |

TABLE 3
| Sample | Polymer (numerals indicate copolymerization weight ratios) |
|---|---|
| Example 9 | 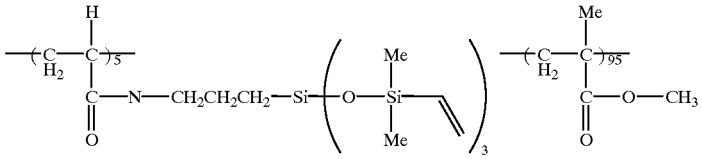 |
| Example 10 | 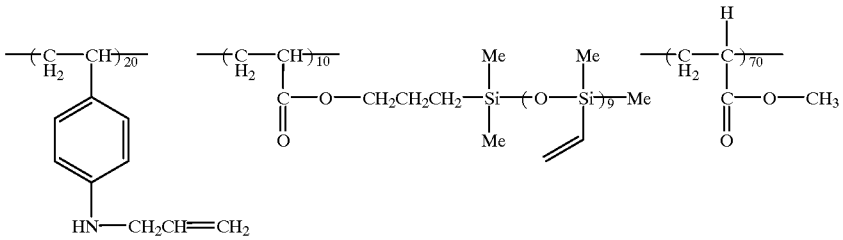 |
| Example 11 | 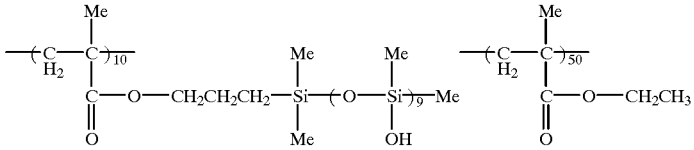 |
| Example 12 | 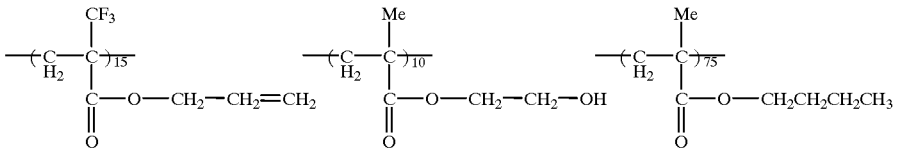 |
| Comparative Example 4 | 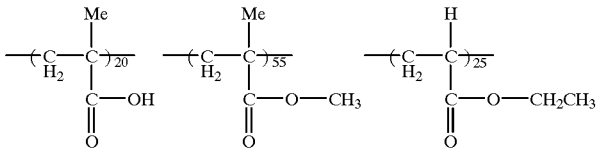 |
Compound A
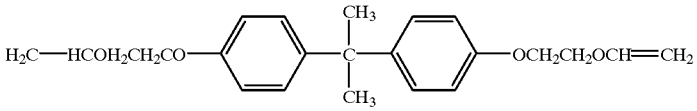
Light-Acid Generating Agent
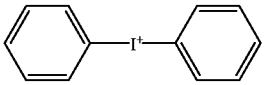
$PF_6^-$ Then, the following coating solution was applied onto each of the above-mentioned light-sensitive layers, heated at 140° C. for 2 minutes, and dried, thereby forming an addition type silicone rubber layer having a dry film thickness of 2.0 μm.

| | |
|---|---|
| α,ω-Divinylpolydimethylsiloxane (degree of polymerization: about 700) | 9.0 g |
| $(CH_3)_3$—Si—O—$(SiH(CH_3)$—O$)_{50}$—$SiH(CH_3$—O$)_{10}$—$Si(CH_3)_3$ | 1.20 g |
| Polydimethylsiloxane (degree of polymerization: about 8,000) | 0.50 g |
| Olefin-Chloroplatinic Acid | 0.20 g |
| Inhibitor [HC≡C—$C(CH_3)_2$—O—$Si(CH_3)_3$] | 0.30 g |
| Isopar G (manufactured by EXXON Corp.) | 140.0 g |

The silicone rubber layer obtained as described above was laminated with a polyethylene terephthalate film having a thickness of 6 μm.

A gray scale different in density by 0.15 was adhered to each of the printing plates, which was exposed with a 2-kW high pressure mercury lamp from a distance of 50 cm for 20 seconds. The laminated films of the exposed light-sensitive lithographic printing plates were peeled off. After heating at 120° C. for 5 minutes, the plates were immersed in a liquid of tripropylene glycol at 40° C. for 1 minute, and thereafter the plate surfaces were rubbed with a developing pad in water. As a result, waterless lithographic printing plates were obtained in which the silicone rubber layers were peeled off to expose the light-sensitive layers in exposed areas and were firmly remained in unexposed areas. The image performance in that case is shown below.

Example 9 A sharp negative image

Example 10 A sharp negative image

Example 11 A sharp negative image

Example 12 A sharp negative image

Comparative Example 4 The silicone layer of the unexposed area was partly peeled off.

The negative working waterless lithographic printing plates of the present invention are excellent in image reproducibility and scratch resistance, and can achieve heat mode recording by laser beams.

What is claimed is:

1. A negative working waterless lithograhic printing plate precursor comprising a support having thereon a light-sensitive layer and a silicone rubber layer provided on said light-sensitive layer, said light-sensitive layer being reduced in adhesion to said silicone rubber layer by exposure, wherein said light-sensitive layer comprises a compound converting a laser beam to heat and a polymer having at least one group selected from the group consisting of a siloxane group and an alkyl fluoride group and at least one group selected from the group consisting of an unsaturated double bond group and a hydroxyl group.

* * * * *